US008136468B2

(12) United States Patent
Rytand et al.

(10) Patent No.: US 8,136,468 B2
(45) Date of Patent: Mar. 20, 2012

(54) HINGE FOR FLOATING DOCK ASSEMBLY

(75) Inventors: David H. Rytand, Anacortes, WA (US); Allen J. Danskine, Bow, WA (US)

(73) Assignee: David H. Rytand, Anacortes, WA (US)

( * ) Notice: Subject to any disclaimer, the term of this patent is extended or adjusted under 35 U.S.C. 154(b) by 316 days.

(21) Appl. No.: 12/391,206

(22) Filed: Feb. 23, 2009

(65) Prior Publication Data

US 2009/0217854 A1 Sep. 3, 2009

Related U.S. Application Data

(60) Provisional application No. 61/030,851, filed on Feb. 22, 2008.

(51) Int. Cl.
*B63B 35/44* (2006.01)

(52) U.S. Cl. ..... 114/263

(58) Field of Classification Search ..... 114/263; 16/270

See application file for complete search history.

(56) References Cited

U.S. PATENT DOCUMENTS

| | | | | |
|---|---|---|---|---|
| 4,453,488 | A | 6/1984 | Watchorn | |
| 5,086,541 | A * | 2/1992 | Autenaud et al. | 16/227 |
| 5,529,012 | A | 6/1996 | Rytand | |
| 6,450,737 | B1 | 9/2002 | Rytand | |
| 6,564,511 | B2 * | 5/2003 | Toth | 49/394 |
| 6,890,120 | B2 | 5/2005 | Hozie | |
| 7,258,384 | B2 * | 8/2007 | Drabik et al. | 296/61 |
| 2006/0018102 | A1 * | 1/2006 | Soderlund | 361/752 |
| 2006/0272566 | A1 * | 12/2006 | Rueckert | 114/263 |
| 2007/0017427 | A1 * | 1/2007 | Rytand | 114/263 |

* cited by examiner

*Primary Examiner* — Stephen Avila
(74) *Attorney, Agent, or Firm* — Klarquist Sparkman, LLP

(57) ABSTRACT

In particular embodiments, a connection assembly for interconnecting two adjacent floats includes first and second hinge mounting members that are secured to respective floats, such as floating concrete dock sections, and a flexible hinge that is releasably connected at each end to the hinge mounting members so as to interconnect the two floats. The hinge mounting members can be, for example, rigid housings that are disposed in respective recesses formed in the concrete dock sections. The flexible hinge includes at least one layer of a flexible material, such as elastomeric belting material, and desirably includes several layers of flexible material, which can be placed in tension across the two floats. In certain embodiments, the hinge mounting members can be easily accessed from the side of the floats adjacent the joint in order to disconnect and remove the hinge for repair or replacement, without having to physically separate the floats.

26 Claims, 10 Drawing Sheets

HINGE FOR FLOATING DOCK ASSEMBLY

CROSS REFERENCE TO RELATED APPLICATION

This application claims the benefit of U.S. Provisional Patent Application No. 61/030,851, filed Feb. 22, 2008, which is incorporated herein by reference.

FIELD

The present disclosure concerns embodiments of a side-accessible connection device for flotation devices, such as floating dock units. The side-accessible connection can also be suitable for interconnecting walkways with floating docks

BACKGROUND

Typical connections for concrete floats employ either flexible connections or steel bolts that extend across the joint between the adjacent ends of two floats, but neither type of connection allows for replacement of the connection without prying the floats apart.

Typical concrete float connections require extensive forming and reinforcing if the concrete is to outlast the failure of a float joint connection. In the event of a failure, which is more desired than having the float destroyed, the floats must be pulled apart to replace the connection apparatus. The positioning of adjacent anchor piles and/or utilities carried internally within the float may make this impossible, or, at the very least, expensive. For example, moving floats apart may be impossible without moving the piles, or, if there are utilities embedded in the floats, the floats may not be able to be moved apart more than by about one inch, which is not enough to replace a failed connection device.

Moreover, prior art float connections typically do not provide suitable flexibility in harsh wave environments, such as about four feet or higher waves. Additionally, prior art float connections typically do not provide suitable adjustability, nor do they permit maintenance of an appropriate tension without employing a steel rod across said joint. Prior art float connections typically also cannot accommodate vertical loads without unduly stressing the concrete floats themselves.

SUMMARY

Certain embodiments of a flexible connection assembly can address the above-mentioned issues of prior art float connections. In particular embodiments, the connection assembly includes first and second hinge mounting members that are secured to respective floating structures, such as floating concrete dock sections, and a flexible hinge that is releasably connected at each end to the hinge mounting members so as to interconnect the two floating structures. The hinge mounting members can be, for example, rigid housings that are disposed in respective recesses formed in the concrete dock sections. The flexible hinge includes at least one layer of a flexible material, such as elastomeric belting material, and desirably includes several layers of flexible material, which can be placed in tension across the two floating structures. Thus, steel tensioning rods, which are prone to failure, especially in a harsh wave environment, are not needed to maintain the appropriate tension between the two floating structures.

Desirably, a strip or pad of a relatively soft material (e.g., a strip made from an elastomeric material such as rubber or neoprene) is placed between the adjacent floating structures to prevent direct contact between them. Consequently, the hinge exhibits sufficient flexibility in a harsh wave environment (typically wave heights of 4 feet and above), yet direct contact between the floats can be avoided.

The connection assembly in certain embodiments is also configured to permit repair or replacement of the flexible hinge without physically separating the two floating structures, which may not even be possible due to the existence of vertical piles or utilities extending through the floating structures. In one implementation, two dock sections (or other floating structures) are placed end-to-end and are interconnected by one or more flexible hinges. The hinge mounting members for each hinge can be accessed from the sides of the dock sections adjacent the joint in order to disconnect the ends of the hinge from the hinge mounting members. Once the hinge is disconnected, it can be removed from the dock sections by sliding it outwardly from the side of the dock sections. The removed flexible hinge can then be repaired by replacing any damaged components or replaced with a new hinge. The repaired or replacement hinge can then be easily re-installed by accessing the hinge mounting members from the side of the dock sections and fastening the ends of the hinge to the hinge mounting members, without having to separate the dock sections.

In particular embodiments, the flexible hinge includes multiple layers of flexible material that are secured to each other with a first set of bolts extending through first ends of the layers and a second set of bolts extending through second ends of the layers. Rigid plate members (e.g., steel plates) can be placed on top of and below the layers where the bolts extend through the layers in order to reinforce the connection. When the ends of the flexible hinge are disconnected from the hinge mounting members, such as for repairing or replacing the hinge, the assembly comprised of the layers of flexible material, plate members and bolts, can be removed from the dock sections as an assembled unit.

One or both ends of the connection assembly can have tensioning means coupled to one end of the hinge and to a corresponding hinge mounting member. For example, a tensioning means can be one or more horizontally extending bolts coupled to an end of the hinge and to a corresponding hinge mounting member. Tightening corresponding nuts on the bolts causes the bolts to apply a tensioning force on the layers of flexible material to place the hinge under tension between the two floats.

In one representative embodiment, a floating dock assembly comprises a first concrete dock section, a second concrete dock section, and a flexible hinge assembly interconnecting the first and second dock sections. The hinge assembly has a first portion releasably connected to the first dock section and a second portion releasably connected to the second dock section such that the hinge assembly can be placed in tension between the dock sections, and such that the first portion can be disconnected from the first dock section and the second portion can be disconnected from the second dock section without separating the dock sections.

In another representative embodiment, a floating dock assembly comprises a first concrete dock section, a second concrete dock section, and a flexible hinge assembly interconnecting the first and second dock sections. The hinge assembly comprises plural layers of flexible material, a first set of bolts extending through first ends of the layers of flexible material, and a second set of bolts extending through second ends of the layers of flexible material. A first hinge mounting member is fixedly secured to the first dock section and releasably coupled to the first ends of the flexible layers.

A second hinge mounting member is fixedly secured to the second dock section and releasably coupled to the second ends of the flexible layers.

In another representative embodiment, a floating dock assembly comprises a first concrete dock section, a second concrete dock section, and a flexible hinge interconnecting the first and second concrete dock sections, the hinge assembly comprising at least one layer of flexible material extending between the dock sections. The assembly further includes tensioning means for placing the at least one layer of flexible material in tension between the dock sections.

In yet another representative embodiment, a method comprises providing a first dock section and a second dock section, providing a flexible hinge assembly comprising at least one layer of flexible material, securing a first end of the layer of flexible material to the first dock section, securing a second end of the layer of flexible material to the second dock section, and tensioning the layer of flexible material.

The foregoing and other features and advantages of the invention will become more apparent from the following detailed description, which proceeds with reference to the accompanying figures.

DETAILED DESCRIPTION

As used in this application and in the claims, the singular forms "a," "an," and "the" include the plural forms unless the context clearly dictates otherwise. Additionally, the term "includes" means "comprises." Further, the term "coupled" means physically, electrically and/or electromagnetically coupled or linked and does not exclude the presence of intermediate elements between the coupled items.

Although the operations of embodiments of the disclosed method are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed system, method, and apparatus can be used in conjunction with other systems, methods, and apparatus. Additionally, the description sometimes uses terms like "produce" and "provide" to describe the disclosed method. These terms may be high-level abstractions of the actual operations that can be performed. The actual operations that correspond to these terms can vary depending on the particular implementation and are discernible by a person of ordinary skill in the art.

Figure 1:
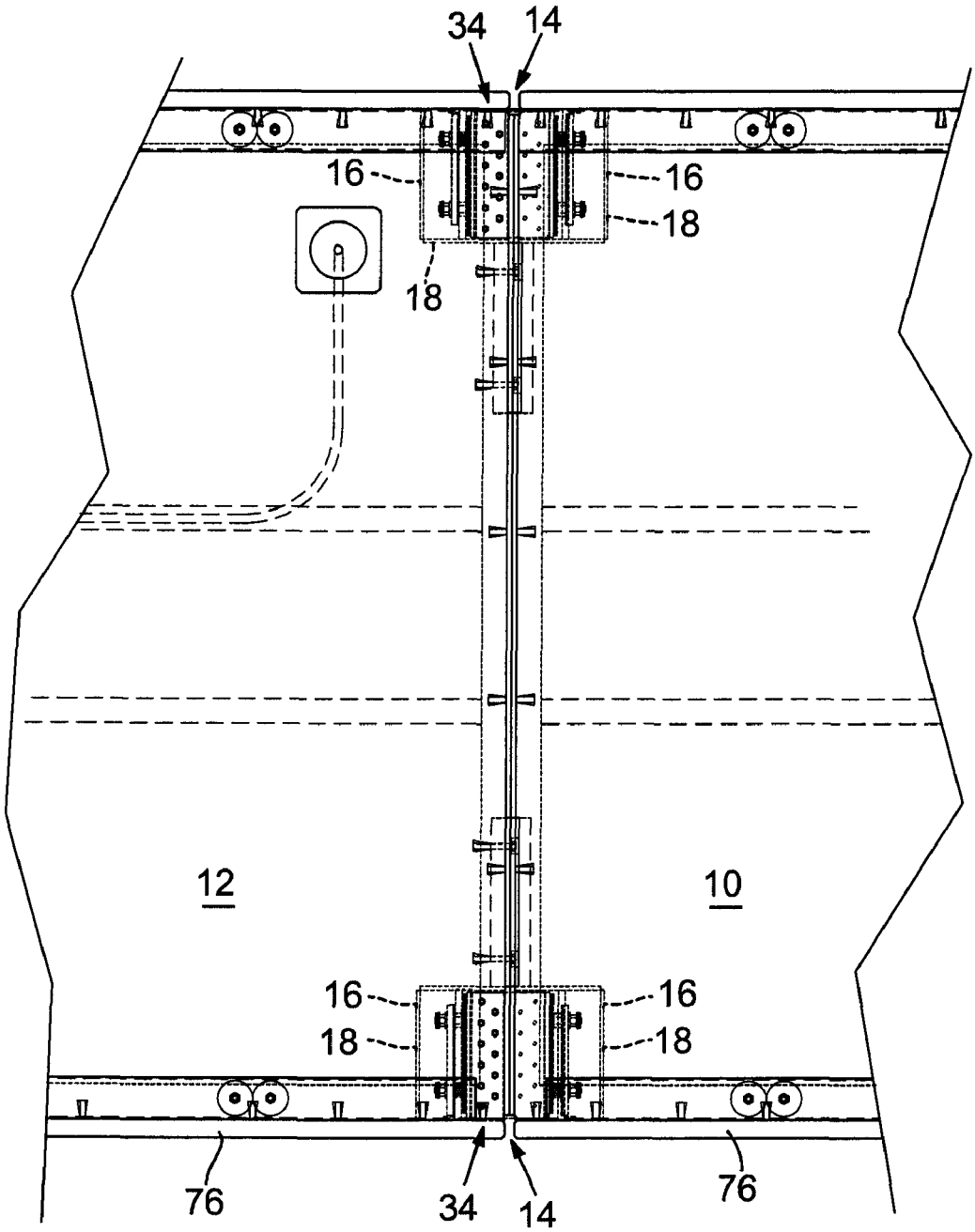
FIG. 1 is a top plan view of two floating dock sections interconnected by two connection assemblies, according to one embodiment.

Referring now to the drawings, FIG. 1 shows a top plan view of first and second floating dock sections 10, 12, which can be connected to each other using one or more flexible connection assemblies 14. Dock sections 10, 12 can have a construction similar to that shown in U.S. Pat. No. 6,450,737, which is incorporated herein by reference. Dock sections 10, 12 can be, for example, concrete dock units housing a buoyant flotation core (not shown). The dock sections 10, 12 are shown placed end-to-end relative to each other and interconnected by at least one connection assembly, indicated generally at 14, and desirably are interconnected by at least two connection assemblies 14 located on opposite sides of dock assembly at the junction of the two dock sections. Embodiments of a flexible connection assembly 14 may advantageously be accessible from the side and/or top of dock sections 10, 12, without requiring separation of the dock sections 10, 12, as further described below.

Figure 2:
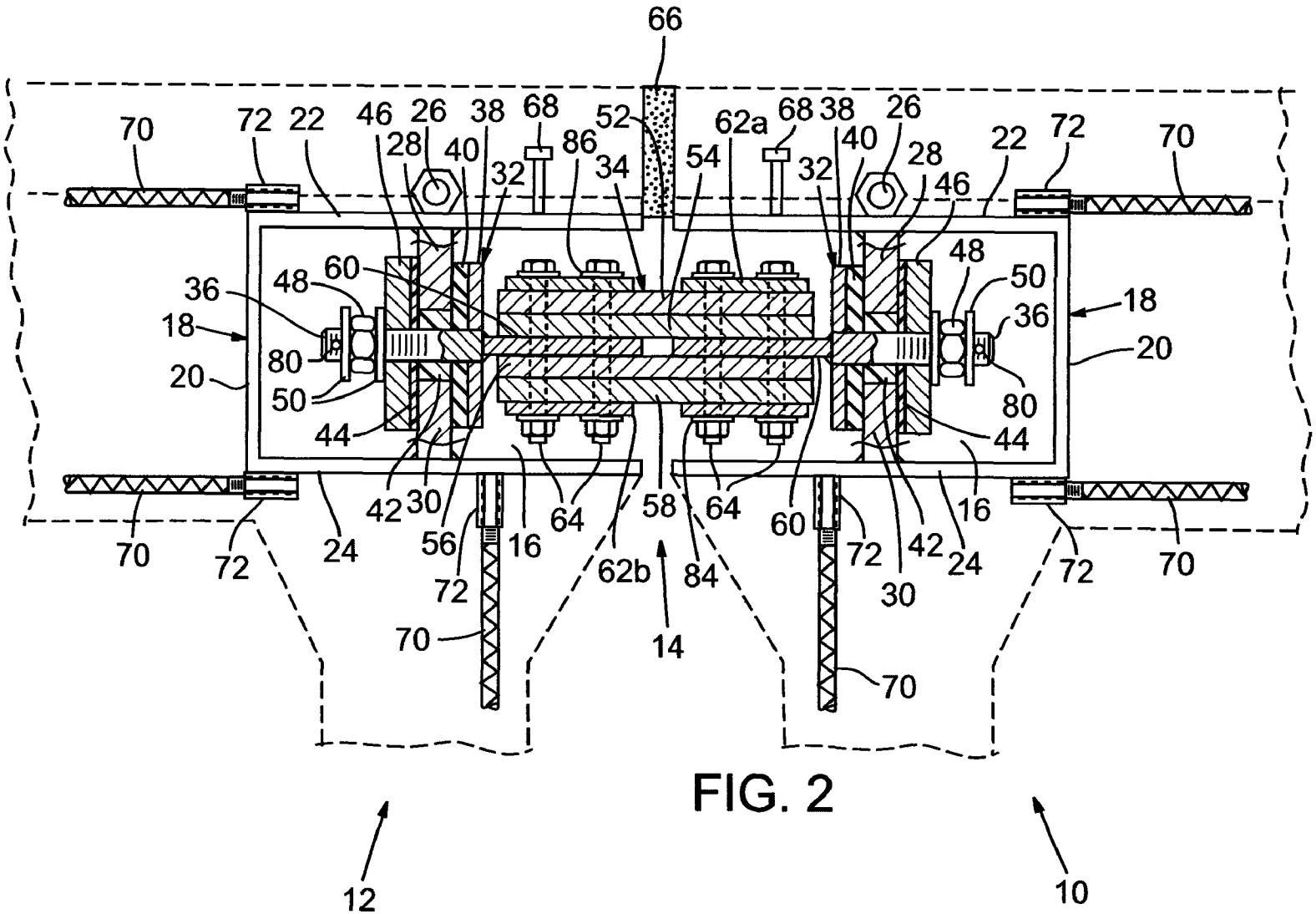
FIG. 2 is a side elevation view of the floating dock sections and one of the assemblies shown in FIG. 1.

As shown in FIGS. 1 and 2, each dock section 10, 12 can each be provided with one or more recesses 16 formed in the concrete end wall of the dock section. Each recess is open to the end and to one side of the respective dock section. In the illustrated embodiment, each dock section has two recesses 16, which are located on opposite sides of the dock section from each other. Dock sections 10, 12 can be arranged such that the recesses 16 of dock section 10 are in alignment with the recesses 16 of dock section 12. Each recess 16 can be sized to receive a respective hinge mounting member in the form of housing 18 (also referred to herein an "end weldment"), which houses a portion of a flexible connection assembly 14 that extends between and interconnects dock sections 10, 12. Two connection assemblies 14 are shown on opposite sides of the floating dock assembly comprising the dock sections 10, 12. In alternative embodiments, more than two connection assemblies 14 can be used if desired. In some embodiments, a single flexible connection assembly 14 may be sufficient to connect the dock sections 10, 12.

FIG. 2 shows a side elevation view of first and second floating dock sections 10, 12, respectively. As noted above, each dock section 10, 12 can be provided with a housing, or end weldment, 18, which is received in a respective recess 16. Each housing 18 can have a rear plate 20 and upper and lower plates 22, 24, respectively. The housings 18 can be fixedly secured to the respective dock section 10, 12, such as by one or more assemblies comprising a piece of rebar 70 and a coupling nut 72. Each nut 72 can be secured to the outer surface of the housing, such as by welding, and secures a piece of rebar that extends horizontally or vertically through the concrete walls of the dock section.

Upper and lower brackets 28, 30, respectively, extend from the upper and lower plates 22, 24, respectively, within each housing 18. A flexible hinge assembly 34 is shown extending between the recesses 16 and can be secured at opposing ends to the housings 18 of the dock sections 10, 12. The adjacent ends of the dock sections 10, 12 desirably are separated from each other by a small distance to allow relative movement between the dock sections 10, 12. An elastomeric pad 66 (e.g., made of rubber) can be disposed in the space between the dock sections 10, 12 to prevent the upper portions of the concrete dock sections 10, 12 from directly contacting each other, while permitting relative movement between the dock sections 10, 12.

Figure 5:
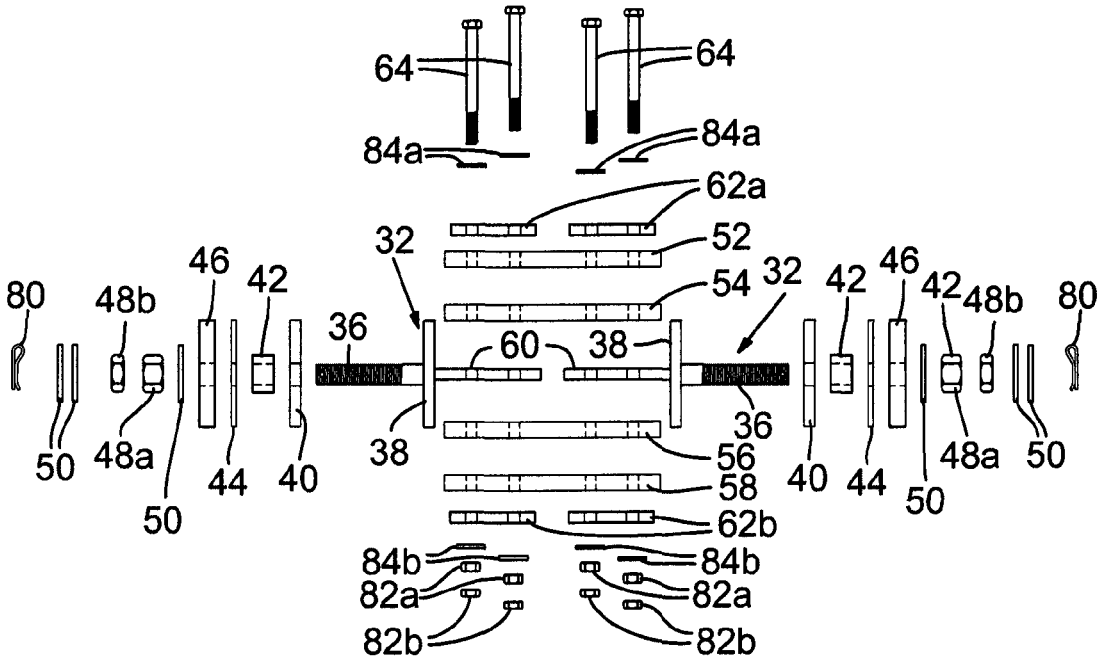
FIG. 5 is an exploded view of the flexible hinge assembly shown in FIG. 3.
Figure 6:
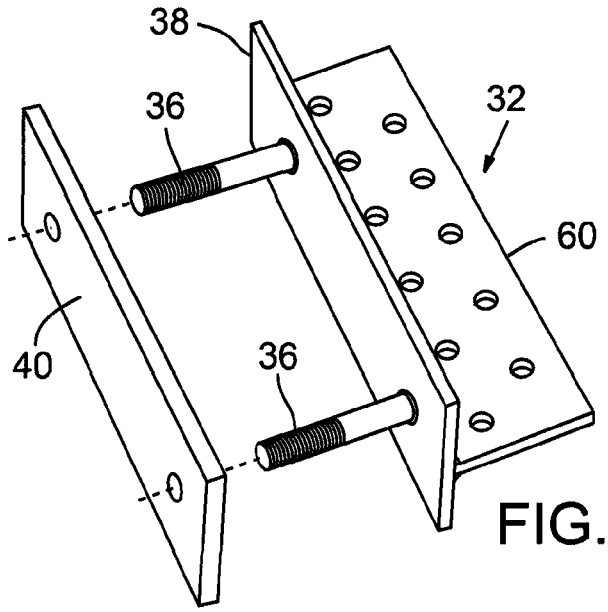
FIG. 6 is a perspective view of a T-shaped bracket used in the flexible hinge assembly shown in FIG. 3.

Referring to FIGS. 2-6, the connection assembly 14 in the illustrated embodiment generally comprises a flexible hinge assembly 34 and housings 18. As best shown in FIG. 2, one half of the hinge assembly 34 extends into and is secured within housing 18 of dock section 10 and the other half of the hinge assembly extends into and is secured within housing 18 of dock section 12. Each end of the hinge assembly 34 can have a T-shaped bracket 32 for securing that end of the hinge assembly within a respective housing 18. As best shown in FIG. 6, each bracket 32 can comprise a vertical plate 38, a horizontally disposed extension or plate 60 extending from the plate 38 in the outboard direction (towards the end of the dock section), and one or more bolts 36 extending from the plate 38 in the inboard direction. The ends of the bolts 36 can be secured to the vertical plate 38 of bracket 32 (such as by welding). An elastomeric layer 40 (e.g., a neoprene pad) may be positioned against the inboard side of the vertical plate 38.

As best shown in FIG. 2, each T-shaped bracket 32 can be secured to upper and lower brackets 28, 30 by the bolts 36, which extend through the elastomeric layer 40, respective bushings 42 located in the space between upper and lower brackets 28, 30, a first plate 44, and a second plate 46. The inboard end of each bolt 36 can be secured, for example, by one or more nuts 48*a*, 48*b* and one or more (e.g., three) washers 50 (FIG. 5) (as shown in FIG. 2, each bolt 36 alternatively can have one nut and two washers). Nut 48*a* can be a standard nut while nut 48*b* can be a jam nut. A cotter pin 80 can be inserted through an opening in the end of each bolt 36. Some embodiments can include a castle nut tightened on the end of each bolt with a corresponding pin extending through the nut and the bolt 36. The bolts 36 and corresponding nuts function as a tensioning mechanism for applying a tensioning force to the flexible hinge assembly, as further described below.

The bushings 42 and the first plate 44 desirably are made from a low friction material, such as UHMW (ultra high molecular weight polyethylene) or another suitable low friction material. The second plate 46 can be made of metal, such as steel, or from various other suitable materials.

The flexible hinge assembly 34 desirably comprises one or more layers of a strong, flexible, energy absorbing material. In the illustrated embodiment, the hinge assembly 34 comprises first and second upper layers 52, 54 and first and second lower layers 56, 58. In particular embodiments, the layers 52, 54, 56, 58 are constructed from elastomeric belting material commonly used in conveyor equipment. One example of such material is PLYLON® fabric-carcassed, rubber belting material manufactured by the Goodyear Tire and Rubber Company of Akron, Ohio. Other suitable materials include other rubbers and flexible polymers capable of providing a flexible connection, preferably with energy absorbing and corrosion-resistant properties.

The first and second upper layers 52, 54 can be arranged above one surface of the horizontal extension 60 of each T-shaped bracket 32, while the first and second lower layers 56, 58 can be arranged below the opposite surface of the horizontal extension 60 such that the extensions 60 are sandwiched by the upper layers 52, 54 and the lower layers 56, 58. The layers 52, 54, 56, 58 can be secured to the horizontal extension 60 of each bracket 32 by vertically extending bolts 64. The number of vertical bolts 64 used should be enough to provide sufficient redundancy in the connection, but the embodiment is not limited to the number of vertical bolts 64 shown.

Figure 3:
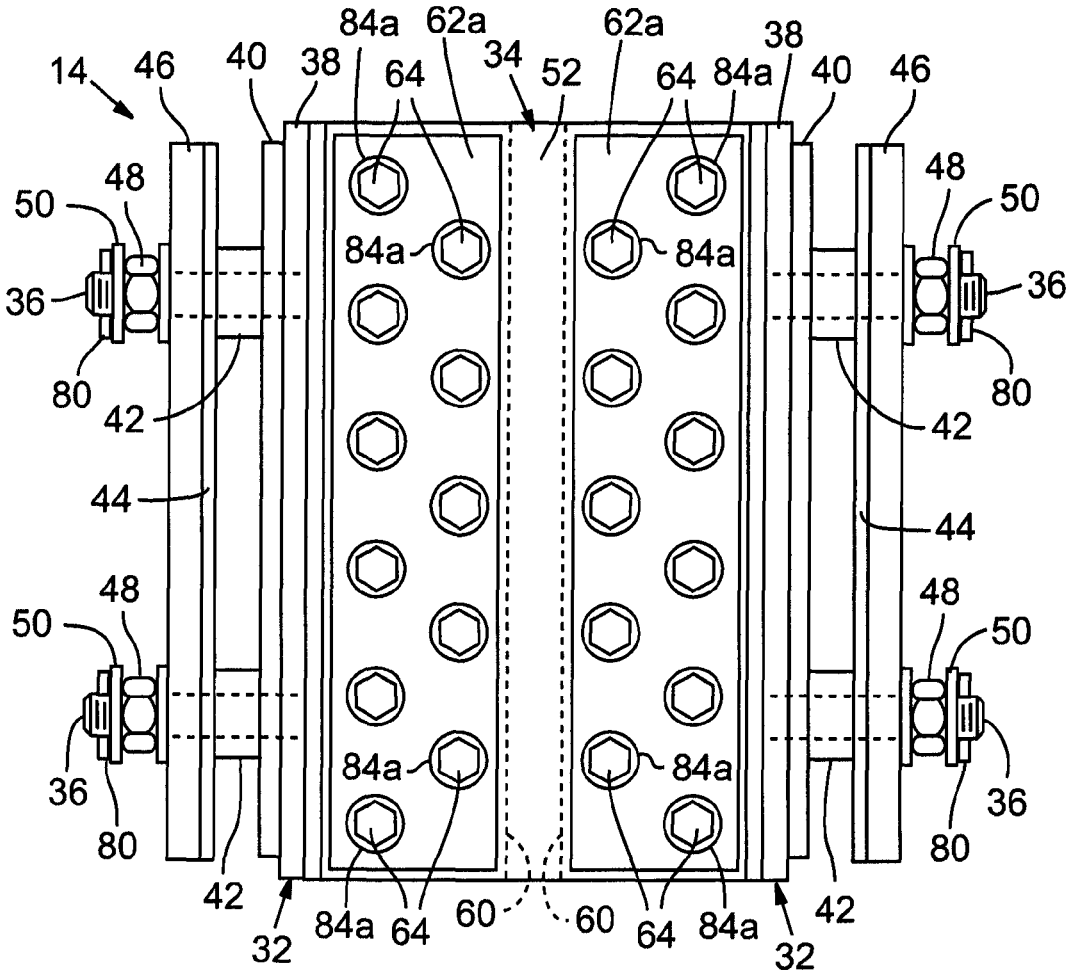
FIG. 3 is a top plan view of the flexible hinge assembly shown in FIG. 2.
Figure 4:
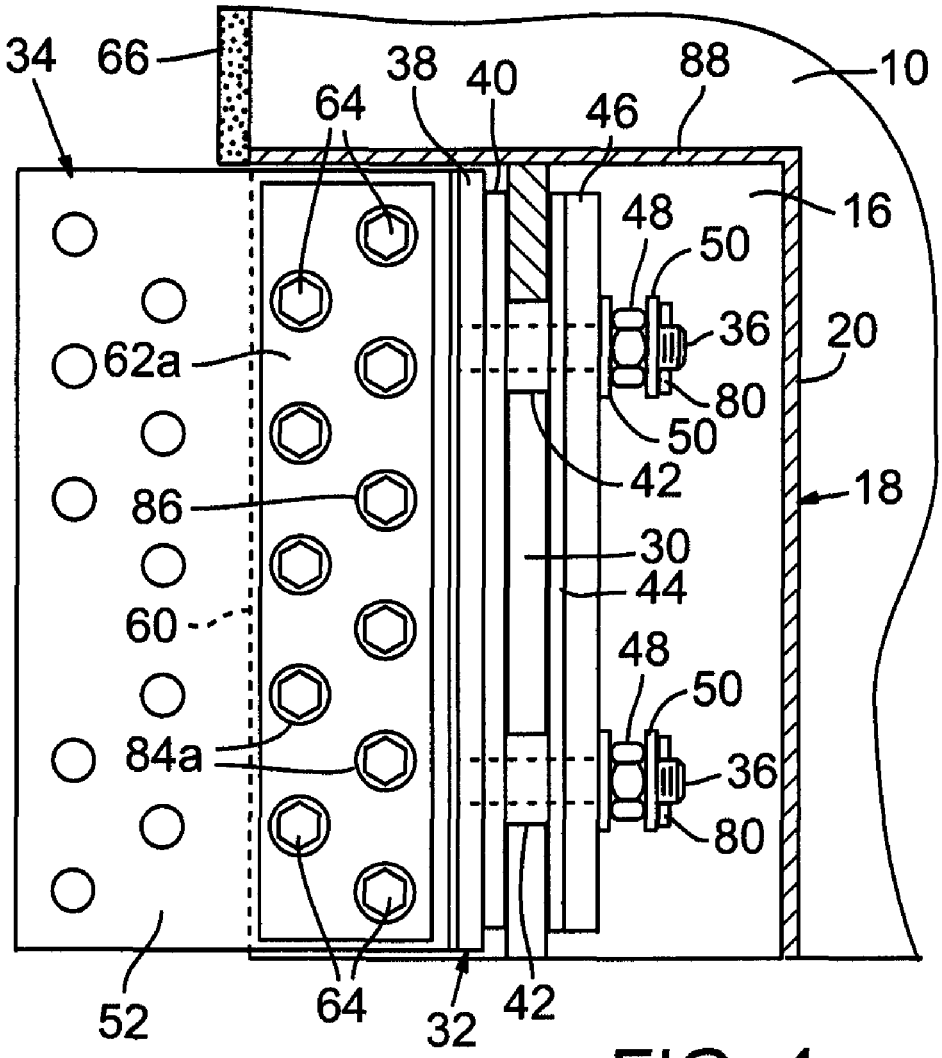
FIG. 4 is a top plan view of a portion of the flexible hinge assembly shown in FIG. 3.

As best shown in FIGS. 3 and 5, each end portion of the flexible hinge 34 desirably is reinforced by an upper plate 62*a* and a lower plate 62*b*, which are made from a substantial rigid material such as steel. The opposing ends of the layers of flexible material are secured to a respective horizontal extension 60 by a respective set of bolts 64, each of which may extend through a respective upper washer 84*a*, a lower washer 84*b*, and corresponding openings in the upper plate 62*a*, the lower plate 62*b*, layers 52, 54, 56, 58, and the horizontal extension 60 (FIG. 5). The lower end of each bolt may be secured by one or more nuts 82*a*, 82*b*. Nut 82*a* can be a standard nut while nut 82*b* can be a jam nut.

Referring to FIG. 2, tightening nuts 48 on bolts 36 within each housing is effective to place the layers of flexible material 52, 54, 56, 58 in tension between the dock sections. More specifically, tightening nuts 48 at the end of the hinge assembly secured to the first dock section 10 applies a tensioning force to the layers of flexible material in the inboard direction toward the first dock section. Similarly, tightening nuts 48 at the end of the hinge assembly secured to the second dock section 12 applies a tensioning force to the layers of flexible material in the inboard direction toward the second dock section. Although less desirable, in alternative embodiments, one end of the hinge assembly can be secured to a respective housing 18 in a non-adjustable manner (i.e., the end of the hinge assembly can be mounted to a housing a fastener that does not itself apply a tensioning force), while the opposite end of the hinge assembly can be adjustable as described above to apply the appropriate amount of tension to the hinge assembly.

If the connection assembly 14 fails or is in need of repair, such as because of a component failure, the connection assembly 14 can be accessed for repair or replacement from the side and/or top of the dock sections 10, 12 without separating or moving the dock sections 10, 12 away from each other. As shown in FIG. 2, the recesses 16 are open to the sides and/or top of dock sections 10, 12. In use, the side openings of the recesses 16 can be covered by a removable or hinged cover (not shown). For example, the side openings of recesses 16 can be covered by a rub strip that extends along the sides of the dock sections 10, 12. The rub strip can be removable or hinged to provide access to the recesses 16. The openings in the side of the dock sections permit the repairman to insert a tool, such as a wrench, into the housings for loosening nuts 48*a*, 48*b*, which allows the entire hinge assembly 34 (including layers 52, 54, 56, 58 still mounted to brackets 32) to be slid outwardly through the openings in dock sections 10, 12 as an assembled unit. Once the hinge assembly 34 is removed, any worn or damaged components (e.g., one or more of layers 52, 54, 56, 58) can be replaced and the refurbished assembly (or new assembly) can be re-installed within the housings 18 in the dock sections.

In contrast, known flexible dock hinges typically are secured to dock sections in a manner that requires the dock sections to be separated a sufficient distance to access the nuts or other fasteners that secure the hinge to the dock sections for repair or replacement of the hinge. As can be appreciated, this procedure can be a difficult and time-consuming process. Moreover, in some cases, dock sections cannot be physically separated to repair or place a hinge due to the presence of vertical piles or utilities extending through the dock sections. The embodiments disclosed in the present application allow a hinge to be repaired or replaced in an efficient manner, even if the presence of a pile or utilities prevent the dock sections from being separated.

Another advantage of the hinge assembly in illustrated configuration is that it allows the appropriate amount of tension to be maintained at the joint between the dock sections without interconnecting the dock sections with one or more steel rod, which are prone to failure in harsh wave environments. Moreover, the illustrated hinge assembly exhibits sufficient flexibility in a harsh wave environment (typically wave heights of 4 feet and above), yet does not allow the adjacent dock sections to contact one another.

In the illustrated embodiment, two horizontal bolts 36 are used to secure each bracket 32 to a pair of upper and lower brackets 28, 30 within a respective housing 18. More or fewer horizontal bolts 36 may be used in other embodiments. As best shown in FIG. 3, the illustrated embodiment also includes eleven vertically extending bolts 64 for securing each end portion of the flexible hinge 34 to a plate 60 within a respective housing 18. Again, more or fewer bolts 64 may be used as appropriate in certain embodiments.

Figure 7:
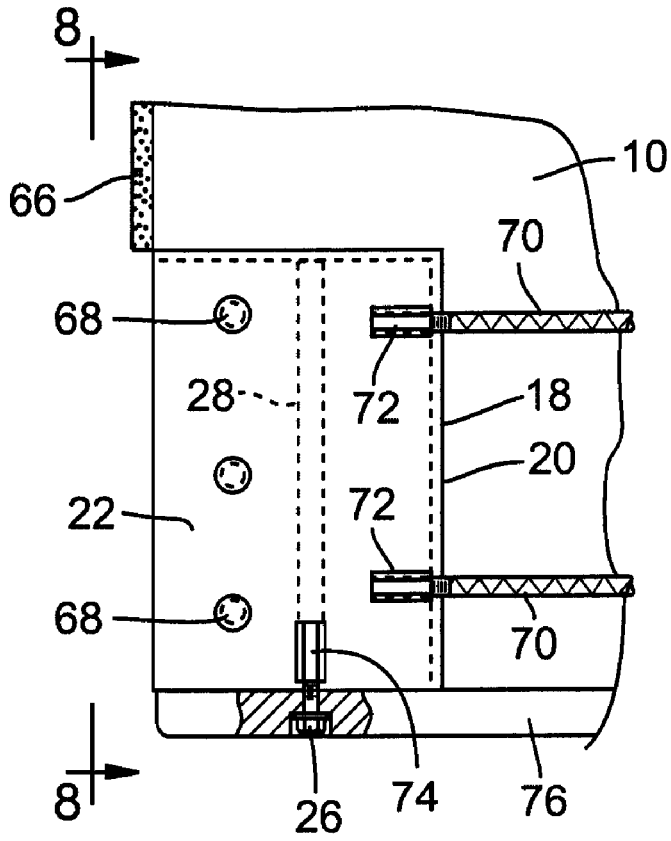
FIG. 7 is a top plan view of the end weldment detail of the connection assembly.
Figure 8:
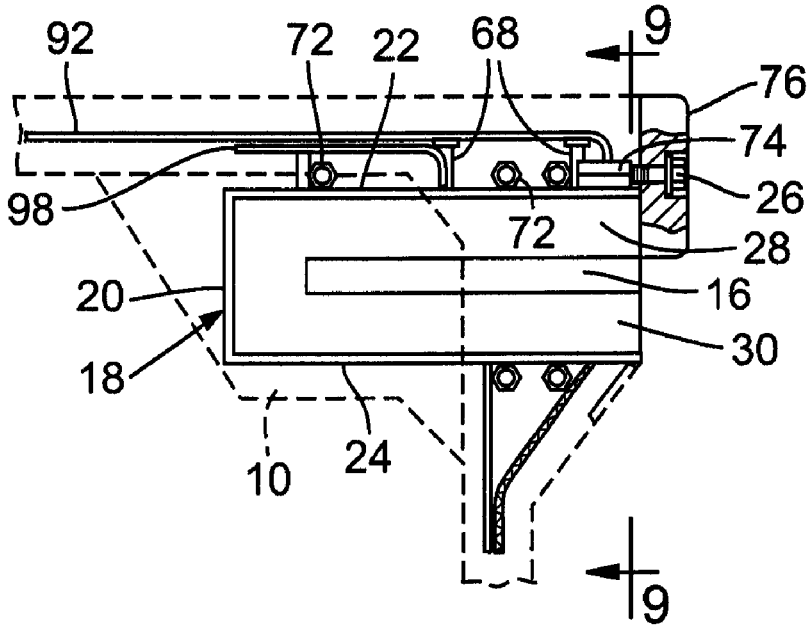
FIG. 8 is an end elevation view of the end weldment shown in FIG. 7, taken along line 8-8.
Figure 9:
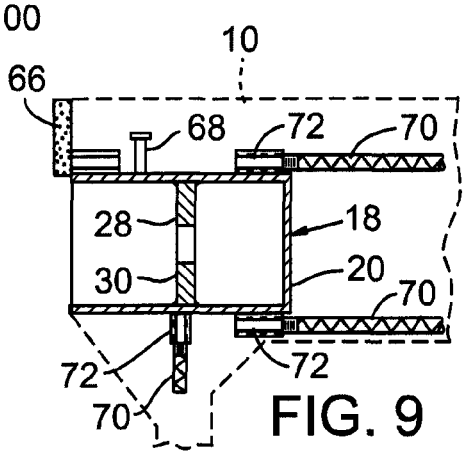
FIG. 9 is a side elevation view of the end weldment taken along line 9-9 of FIG. 8.

FIGS. 7-9 illustrate different views of the housing, or end weldment 18, and its placement within dock section 10. FIG. 7 shows a top plan view of the end weldment 18; FIG. 8 shows an end elevation view of the end weldment 18 shown in FIG. 7, taken along line 8-8; and FIG. 9 shows a side elevation view of the end weldment shown in FIG. 7, taken along line 9-9. As noted above, the end weldment 18 can be secured to the dock section 10 via couplings 72 and respective pieces of rebars 70. One or more studs 68 can extend upwardly from the top plate 22 of the end weldment 18 to further secure the end weldment to the surrounding concrete. As best shown in FIG. 7, a rub strip 76 can extend along the side of dock section 10. The rub strip can be secured to the dock section with a bolt 26 tightened into a nut 74 secured to the top plate 22 of the end weldment 18.

In addition to connecting multiple floating dock sections to one another, some embodiments of a flexible connection assembly can also be used for connecting floating dock sections to a main float (e.g., a gangway). FIGS. 10-13, for example, shows a main float 100 that is formed with recess or opening in one side of the main float that is sized to received a hinge mounting member in the form of a housing, or end weldment, 102. The housing 102 can have side walls 104, a back wall 106, a top wall 108, and a bottom wall 110, and can be open at the side 116 of the main float, opposite back wall 106, to permit access into the housing. The housing 102 receives one half of a flexible hinge assembly 112. The other half of the hinge assembly 112 extends into and is secured to a housing (e.g., housing 18) of a dock section 114 that extends in a perpendicular relationship relative to the main float 100. Although only one connection assembly 112 is shown in the figures, the dock section 114 can be interconnected to the main float 100 with an identical connection assembly positioned at the end of the dock section 114 adjacent its opposite side.

The main float 100 can be connected in a similar fashion to multiple dock sections 114 that are spaced along the length of the main float in a perpendicular relationship relative to the main float. In a similar manner, two dock sections can be interconnected in a perpendicular relationship with one or more connection assemblies 112 that extend between an end of one dock section and the adjacent side of another dock section. The main float 100 can be a concrete structure having a buoyant flotation core (not shown), similar to dock sections 10, 12 described above.

The hinge assembly 112 can have a construction similar to that of the connection assembly 14 described in detail above. Thus, components in the embodiment of FIGS. 10-13 that are similar to components of the embodiment of FIGS. 1-9 are given the same respective reference numbers and are not further described.

Desirably, the housing 102 in the side of the main float is elongated along the length of the main float and is sized to permit access into the interior of the housing from the side 116 of the main float. As shown, the housing 102 has an interior space 118 that can be accessed from the side 116 of the main float and is large enough to allow personnel to insert a wrench or other tools into the housing for loosening nuts 48 that secure the connection assembly 112 to brackets 28, 30 inside the housing for repairing or replacing the connection assembly. After loosening nuts 48 (and the nuts 48 securing the other half of the hinge assembly to the dock section 114), the entire hinge assembly 112 can be removed by sliding it in the direction of arrow 120 until the connection assembly clears the brackets 28, 30 (and the corresponding brackets 28, 30 in the dock section 114), after which the connection assembly can be withdrawn from the housing 102 via the opening in the side 116 of the main float. Again, removal of the hinge assembly can be accomplished relatively quickly without having to physically separate the dock section from the main float.

Figure 11:
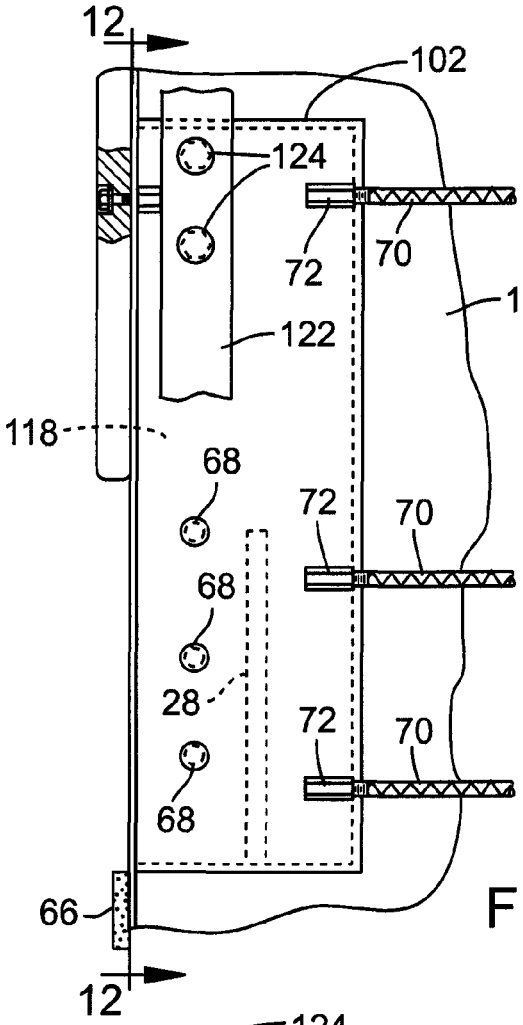
FIG. 11 is a top plan view of the weldment detail for the main float shown in FIG. 10.
Figure 12:
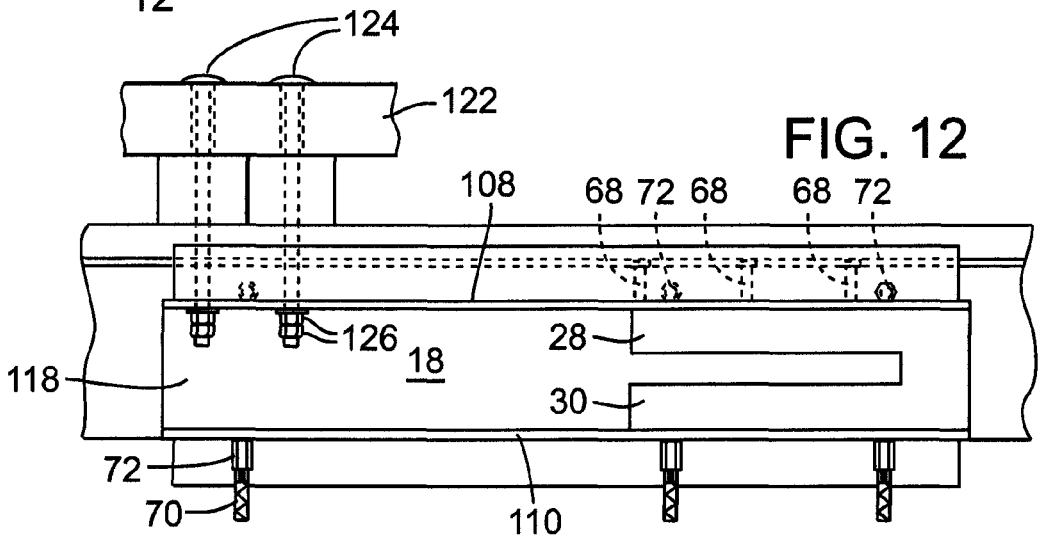
FIG. 12 is an end elevation view of the weldment detail shown in FIG. 11, taken across line 12-12.
Figure 10:
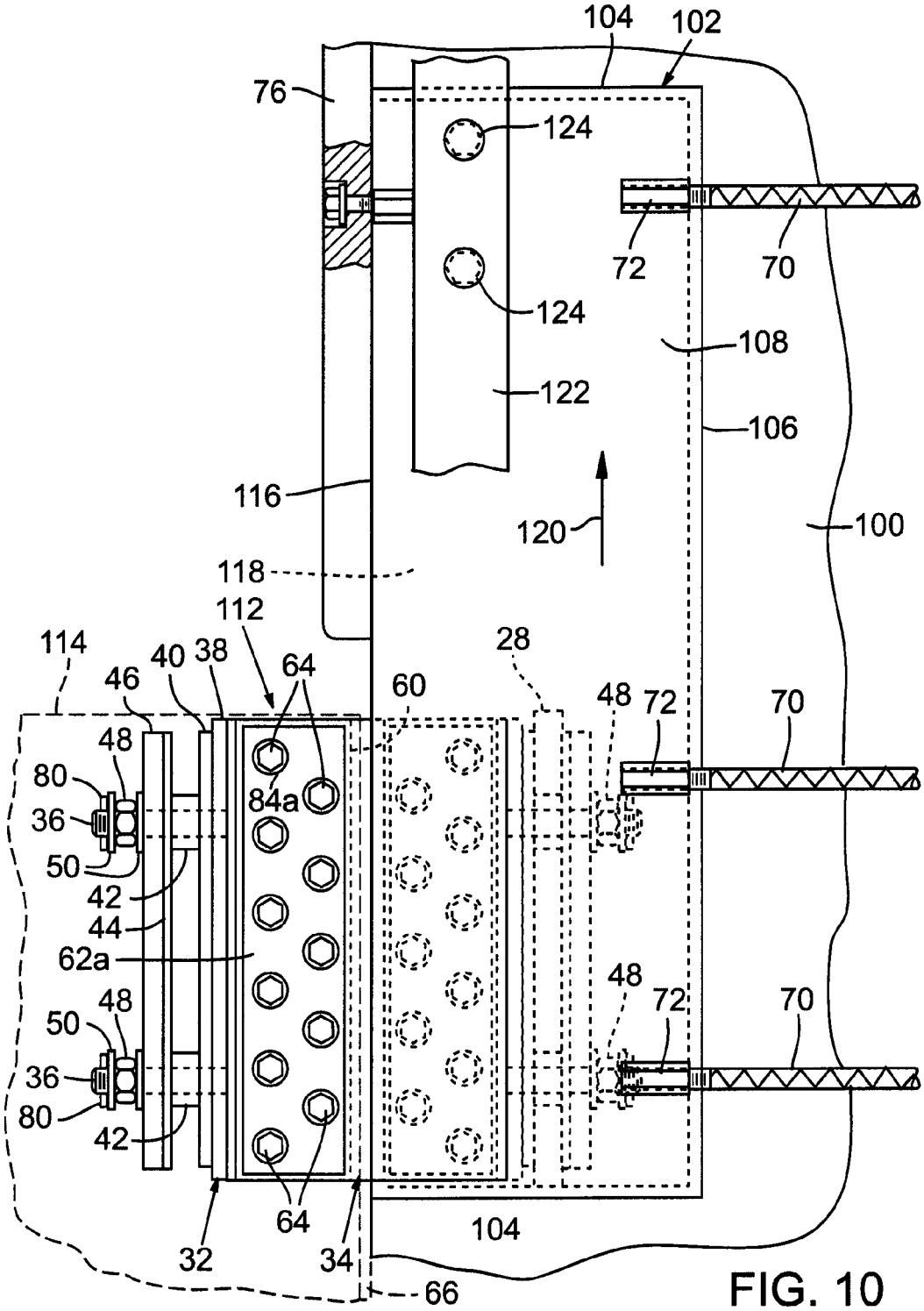
FIG. 10 is a top plan view of a dock section connected to a main float by a flexible connection assembly, according to another embodiment.
Figure 13:
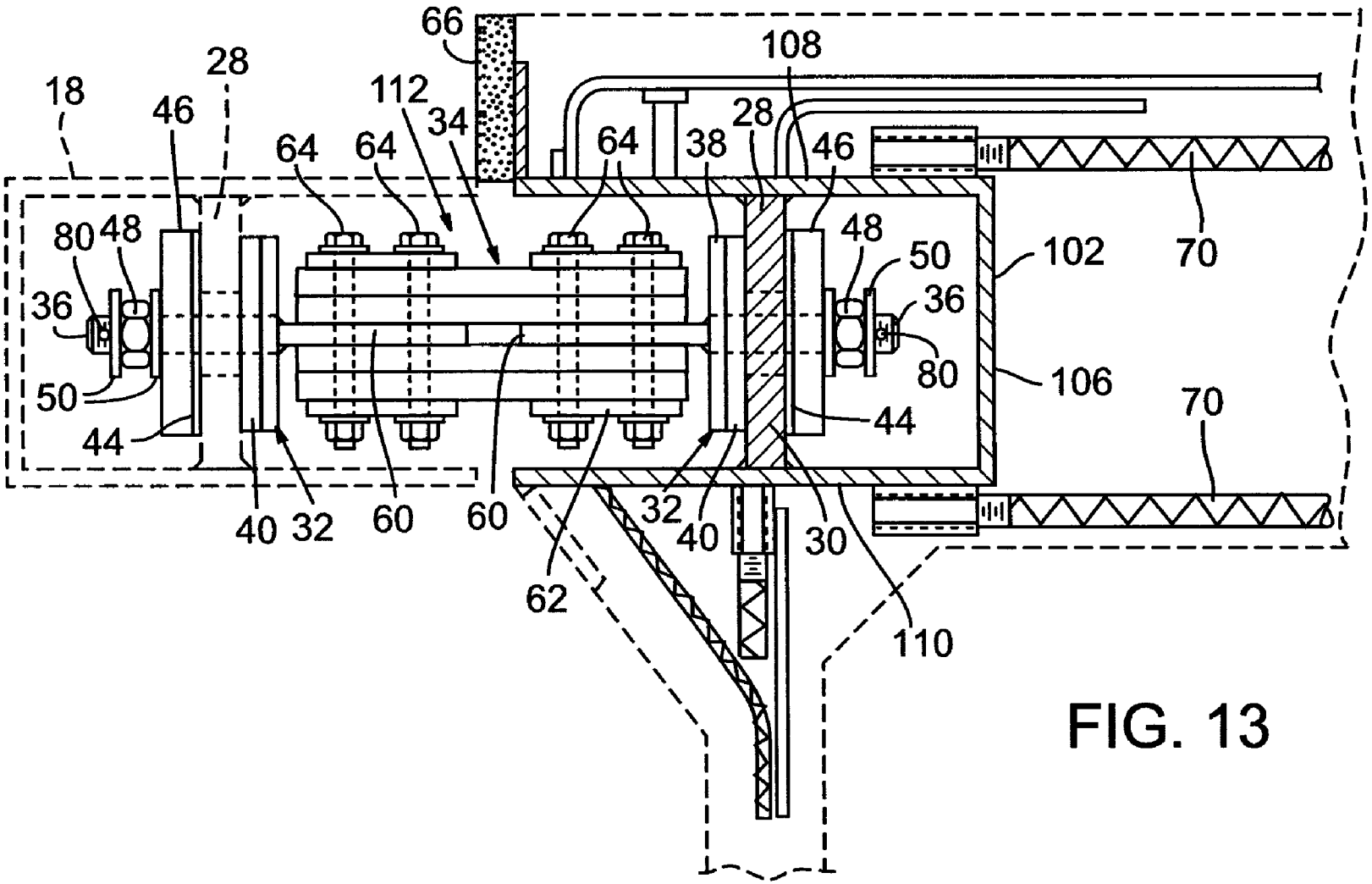
FIG. 13 is a side elevation view of the connection assembly shown in FIG. 10.

If desired, the housing 102 can be utilized to help mount any of various mooring accessories to the top and/or side of the main float. As best shown in FIGS. 11-12, for example, an elongated rail 122 can be mounted to the upper surface of the main float by bolts 124 that extend vertically through the upper surface of the main float and the top wall 108 of the housing 102, and are secured with respective nuts 126 inside the housing. Advantageously, because the nuts 126 are easily accessible via the opening in the housing, this manner of mounting the rail 122 (or other accessories mounted to the main float) allows the rail and the bolts 124 to be easily removed from the main float for repairing or replacing the rail and/or replacing any damaged bolts. The same mounting technique can be used to mount accessories to other floating structures, such as dock sections 10, 12, 114.

Figure 14:
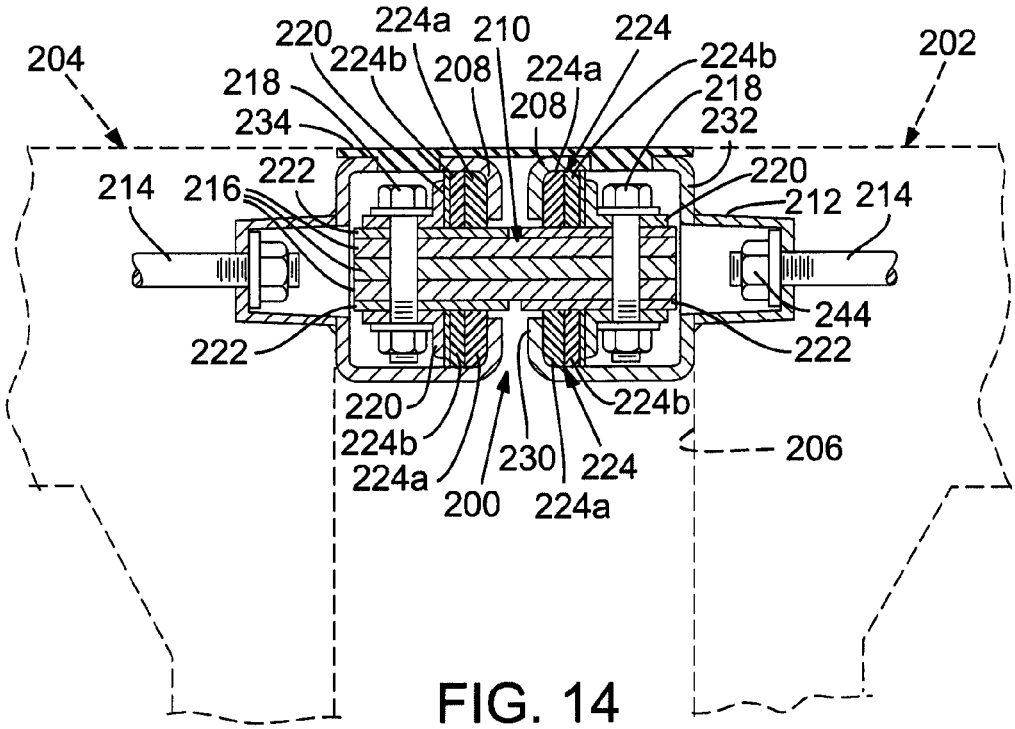
FIG. 14 is a side elevation view of two floating dock sections interconnected by a flexible connection assembly, according to another embodiment, showing the connection assembly partially in section.
Figure 15:
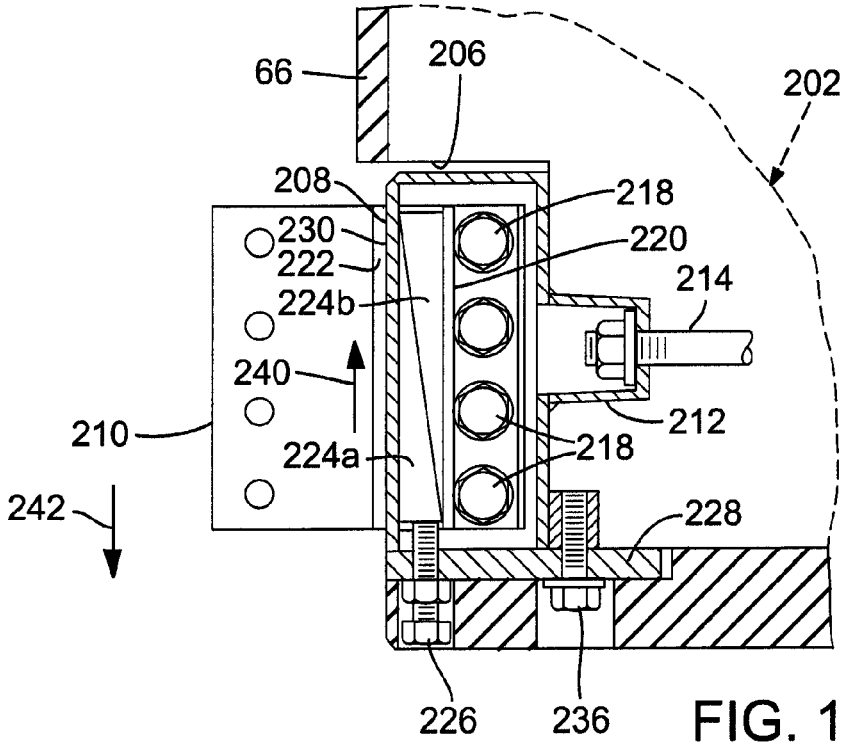
FIG. 15 is a top plan view of one of the floating dock sections shown in FIG. 14 showing the connection assembly partially in section.

FIGS. 14-15 illustrate another embodiment of a connection assembly, indicated at 200, that can be used to interconnect two floating structures, such as two dock sections 202, 204. In the illustrated embodiment, the connection assembly 200 interconnects dock sections 202, 204, which are placed end-to-end relative to each other. Desirably, two connection assemblies 200 are used to interconnect the dock sections, with the connection assemblies extending between the adjacent ends of the dock sections and positioned adjacent opposite sides of the dock assembly.

As best shown in FIG. 15, each dock section can have a recess 206 that desirably is open to the end, side and top of the dock section. A hinge mounting member in the form of a housing, or end weldment, 208 is disposed in each recess 206 and secures one end portion of a flexible hinge assembly 210 to the corresponding dock section, as further described below. Each housing 208 has an outboard side wall 230 and an inboard side wall 232. Side wall 230 has a central opening 238 through which the hinge assembly 210 extends. Each housing 208 can be secured to a respective dock section 202, 204 by a tapered sleeve 212 that is secured to side wall 232 and extends into a respective opening of the dock section. An anchor bolt 214 extends longitudinally into the dock section and is fixedly secured thereto. A nut 244 is tightened onto the end of the anchor bolt to secure the housing to the dock section.

The flexible hinge assembly 210 comprises, for example, one or more layers 216 (three are shown in the illustrated embodiment) of a strong, flexible material, such as PLYLON® belting material. Within each housing, upper and lower L-shaped brackets 220 and upper and lower plates 222 are positioned on opposite sides of the layers 216. Vertical bolts 218 extend through corresponding openings in the L-shaped brackets 220, plates 222, and layers 216, securing these components to each other. Within each housing 208, an upper shim assembly 224 is positioned between the upper L-shaped bracket 220 and an outer side wall 230 of the respective housing 208 and a lower shim assembly is positioned between the lower L-shaped bracket 220 and the outer side wall 230 of the respective housing 208.

As best shown in FIG. 15, each shim assembly 224 in the illustrated embodiment comprises a first wedge-shaped shim 224*a* and a second wedge-shaped shim 224*b*. Shims 224*a*, 224*b* desirably are made of a low friction material, such as UHMW. A respective adjustment bolt 226 extends through a retainer plate 228 covering the side opening of the recess 206 and bears against the first shim 224*a*. The retainer plate 228 can be secured to the side of the dock section with one or more bolts 236. Tightening the adjustment bolt 226 is effective to move the first shim 224*a* relative to the second shim 224*b* in the direction of arrow 240. Movement of the first shim 224*a* in this direction is effective to increase the distance between L-shaped bracket 220 and the side wall 230 of housing 208. This in turn causes the ends of layers 216 to move toward the inboard side wall 232 of housing 208. Hence, as shown in FIG. 14, the adjustment bolts 226 (each upper and lower shim assembly has a respective bolt 226 that bears against a respective shim 224*a*) can be sufficiently tightened until the ends of layers 216 contact the side wall 232 to retain the hinge assembly against movement relative to the housing 208. This is also effective to place the layers of flexible material in tension between the dock sections.

As shown in FIG. 14, the top of the recesses 206 can be covered by a cover 234, which extends over and covers the connection assembly. The cover 234 can comprise a thin layer of rubber, such as D Grip Roughtop material available from Goodyear.

If the connection assembly fails or is in need of repair, such as because of a component failure, it can be accessed for repair or replacement from the side of the dock sections 202, 204 by first loosening bolts 226, and removing bolts 236 and side plates 228. Loosening bolts 226 introduces slack between the ends of layers 216 and the corresponding housings 208 so that the entire hinge assembly 210 can be removed by sliding it outwardly from the housings 208 in the direction of arrow 242. As can be appreciated, the hinge assembly can be repaired or replaced without moving the dock sections 202, 204 apart from each other, which may not even be possible due to vertical piles or utilities extending through the dock sections.

Although floating dock sections are shown in the illustrated embodiment, one or more flexible connection assemblies as disclosed herein can be used to connect other types of flotation devices or water-borne structures to each other in the form of a wharf, floating bridge, or the like.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. A floating dock assembly comprising:

a first concrete dock section;

a second concrete dock section; and a flexible hinge assembly interconnecting the first and second dock sections, the hinge assembly having a first portion releasably connected to the first dock section, without a bolt passing through both the hinge assembly and the first dock section, and a second portion releasably connected to the second dock section, without a bolt passing through both the hinge assembly and the second dock section, such that the first portion can be disconnected from the first dock section and the second portion can be disconnected from the second dock section without separating the dock sections and without removing any bolts that extend through and connect the hinge assembly to the first dock section and the hinge assembly to the second dock section;

wherein the first portion of the flexible hinge assembly is secured within a recess formed in the first dock section and the second portion of the flexible hinge assembly is secured within a recess formed in the second dock section; and a first housing disposed in the recess in the first dock section and a second housing disposed in the recess in the second dock section such that the first portion of the hinge assembly is disposed in the first housing and the second portion of the hinge assembly is disposed in the second housing.

2. A floating dock assembly comprising:

a first concrete dock section;

a second concrete dock section;

a flexible hinge assembly interconnecting the first and second dock sections, the hinge assembly having a first portion releasably connected to the first dock section and a second portion releasably connected to the second dock section such that the first portion can be disconnected from the first dock section and the second portion can be disconnected from the second dock section without separating the dock sections;

wherein the first portion of the flexible hinge assembly is secured within a recess formed in the first dock section and the second portion of the flexible hinge assembly is secured within a recess formed in the second dock section; and a first housing disposed in the recess in the first dock section and a second housing disposed in the recess in the second dock section;

wherein:

the dock sections are positioned end-to-end such that an end of the first dock section is interconnected to an adjacent end of the second dock section by the hinge assembly; and the first housing has an opening at one side of the first dock section and the second housing has an opening at one side of the second dock section such that the hinge assembly, when disconnected from the dock sections, can be removed from the housings via the openings in the housings.

3. A floating dock assembly comprising:

a first concrete dock section;

a second concrete dock section;

a flexible hinge assembly interconnecting the first and second dock sections, the hinge assembly having a first portion releasably connected to the first dock section and a second portion releasably connected to the second dock section such that the first portion can be disconnected from the first dock section and the second portion can be disconnected from the second dock section without separating the dock sections;

a first housing secured to the first dock section and having a first bracket;

a second housing secured to the second dock section and having a second bracket;

the hinge assembly comprising plural layers of flexible material, and first and second bolts, the first bolt having a first end coupled to the layers of flexible material and a second end coupled to the first bracket within the first housing, and the second bolt having a first end coupled to the layers of flexible material and a second end coupled to the second bracket within the second housing.

4. The floating dock assembly of claim 3, further comprising a first nut disposed on the second end of the first bolt and a second nut disposed on the second end of the second bolt such that tightening the first and second nuts places the layers of flexible material in tension between the dock sections.

5. A floating dock assembly comprising:

a first concrete dock section;

a second concrete dock section;

a flexible hinge assembly interconnecting the first and second dock sections, the hinge assembly having a first portion releasably connected to the first dock section and a second portion releasably connected to the second dock section such that the first portion can be disconnected from the first dock section and the second portion can be disconnected from the second dock section without separating the dock sections;

a first housing secured to the first dock section;

a second housing secured to the second dock section;

the hinge assembly comprising plural layers of flexible material, at least one shim assembly disposed in the first housing and at least one shim assembly disposed in the second housing, each shim assembly being coupled to the layers of flexible material and comprising at least first and second shims that are adjustable relative to each other to increase tension in the layers of flexible material.

6. A floating dock assembly comprising:

a first concrete dock section;

a second concrete dock section; and a flexible hinge assembly interconnecting the first and second dock sections, the hinge assembly having a first portion releasably connected to the first dock section and a second portion releasably connected to the second dock section such that the first portion can be disconnected from the first dock section and the second portion can be disconnected from the second dock section without separating the dock sections, wherein the hinge assembly comprises:

plural layers of flexible material;

first and second, rigid upper plates disposed on top of the layers of flexible material;

first and second, rigid lower plates disposed below the layers of flexible material;

a first set of bolts extending through the first upper plate, first ends of the layers of flexible material, and the first lower plate; and a second set of bolts extending through the second upper plate, second ends of the layers of flexible material, and the second lower plate.

7. The floating dock assembly of claim 6, wherein the layers of flexible material, the upper plates, the lower plates, and the first and second sets of bolts can be removed from the dock sections as an assembled unit when the hinge assembly is disconnected from the dock sections.

8. A floating dock assembly comprising:

a first concrete dock section;

a second concrete dock section;

a flexible hinge assembly interconnecting the first and second dock sections, the hinge assembly comprising plural layers of flexible material, a first set of bolts extending through first ends of the layers of flexible material, a second set of bolts extending through second ends of the layers of flexible material;

a first hinge mounting member fixedly secured to the first dock section and releasably coupled to the first ends of the flexible layers;

a second hinge mounting member fixedly secured to the second dock section and releasably coupled to the second ends of the flexible layers;

first tensioning means coupled to the first hinge mounting member and the first ends of the layers of flexible material for tensioning the layers of flexible material; and second tensioning means coupled to the second hinge mounting member and the second ends of the flexible material for tensioning the layers of flexible material.

9. The floating dock assembly of claim 8 wherein:

the first tensioning means comprises a first bolt having a first end coupled to the first ends of the layers of flexible material and a second end coupled to the first hinge mounting member, the first tensioning means also comprising a first nut secured to the second end of the first bolt; and the second tensioning means comprises a second bolt having a first end coupled to the second ends of the layers of flexible material and a second end coupled to the second hinge mounting member, the second tensioning means also comprising a second nut secured to the second end of the second bolt;

wherein tightening the first and second nuts increases tension in the layers of flexible material.

10. The floating dock section of claim 8, wherein:

the first tensioning means comprises a first shim assembly coupled to the first ends of the layers of flexible material and the first hinge mounting member; and the second tensioning means comprises a second shim assembly coupled to the second ends of the layers of flexible material and the second hinge mounting member;

wherein the shim assemblies are adjustable to increase tension in the layers of flexible material.

11. The floating dock assembly of claim 8, wherein the layers of flexible material, the first set of bolts, and the second set of bolts can be removed from the dock sections as an assembled unit when the hinge assembly is released from the first and second hinge mounting members.

12. The floating dock assembly of claim 11, wherein the layers of flexible material, the first set of bolts, and the second set of bolts can be removed from the dock sections as an assembled unit when the hinge assembly is released from the first and second hinge mounting members and without separating the dock sections from each other.

13. The floating dock assembly of claim 9, wherein the first hinge mounting member comprises a housing disposed in a recess in the first dock section and the second hinge mounting member comprises a housing disposed in a recess in the second dock section.

14. A floating dock assembly, comprising:

a first concrete dock section;

a second concrete dock section;

a flexible hinge interconnecting the first and second concrete dock sections, the hinge assembly comprising at least one layer of flexible material extending between the dock sections;

the first dock section comprising a first housing which houses a first portion of the hinge;

the second dock section comprising a second housing which houses the second portion of the hinge; and wherein the first and second housings are configured to retain the first and second portions of the hinge, respectfully, to interconnect the first and second dock sections.

15. The floating dock assembly of claim 14, further comprising tensioning means for placing the at least one layer of flexible material in tension between the dock sections, wherein the tensioning means comprises a first tensioning means connected to the first dock section for applying a tensioning force on the at least one layer of flexible material in a direction toward the first dock section and a second tensioning means connected to the second dock section for applying a tensioning force on the at least one layer of flexible material in a direction toward the second dock section.

16. The floating dock section of claim 14, wherein the at least one layer of flexible material can be removed from the first and second dock sections without separating the dock sections from each other.

17. A method comprising:

providing a first dock section and a second dock section;

providing a flexible hinge assembly comprising at least one layer of flexible material;

placing a first end of the flexible hinge assembly in a housing of the first dock section such that the first end is retained within the housing; and placing a second end of the hinge assembly in a housing of the second dock section such that the second is retained within the housing.

18. The method of claim 17, further comprising removing the flexible hinge assembly from the housings substantially without separating the first and second dock sections.

19. The method of claim 18, further comprising replacing the removed flexible hinge assembly with a repaired, refurbished, or substitute flexible hinge assembly and securing it to the first and section dock sections substantially without separating the first and second dock sections.

20. A floating dock assembly comprising:

a first concrete dock section;

a second concrete dock section;

a flexible hinge assembly interconnecting the first and second dock sections, the hinge assembly having a first portion releasably connected to the first dock section and a second portion releasably connected to the second dock section, such that the first portion can be disconnected from the first dock section and the second portion can be disconnected from the second dock section without separating the dock sections;

the first dock section comprising a first housing having an opening at one side of the first dock section which houses the first portion of the hinge assembly; and the second dock section comprising a second housing having an opening at one side of the second dock section which houses the second portion of the hinge assembly, such that the hinge assembly, when disconnected from the dock sections, can be removed from the housings via the openings in the housings.

21. A floating dock assembly comprising:

a first concrete dock section;

a second concrete dock section; and a flexible hinge assembly interconnecting the first and second dock sections, the hinge assembly having a first portion releasably connected to the first dock section, and a second portion releasably connected to the second dock section, the flexible hinge assembly comprising at least one layer of flexible, elastomeric belting material;

the first dock section comprising a first recess and the second dock section comprising a second recess; and a first housing disposed in the first recess in the first dock section and a second housing disposed in the second recess in the second dock section;

wherein the first portion of the flexible hinge assembly is secured within the first housing and the second portion of the flexible hinge assembly is secured within the second housing.

22. The dock assembly of claim 21, further comprising:

a first shim assembly disposed in the first housing, the first shim assembly comprising at least one upper shim and at least one lower shim, the at least one upper shim positioned between an upper surface of the hinge assembly and an upper portion of the first housing, the at least one lower shim positioned between a lower surface of the hinge assembly and a lower portion of the first housing; and a second shim assembly disposed in the second housing, the second shim assembly comprising at least one upper shim and at least one lower shim, the at least one upper shim positioned between an upper surface of the hinge assembly and an upper portion of the second housing, the at least one lower shim positioned between a lower surface of the hinge assembly and a lower portion of the second housing.

23. The dock assembly of claim 21, wherein:

the first housing comprises an upper plate, a lower plate, an upper bracket extending downwardly from the upper plate and a lower bracket extending upwardly from the lower plate;

the second housing comprises an upper plate, a lower plate, an upper bracket extending downwardly from the upper plate and a lower bracket extending upwardly from the lower plate;

the first portion of the flexible hinge extends through a slot between the upper and lower brackets of the first housing; and the second portion of the flexible hinge extends through a slot between the upper and lower brackets of the second housing.

24. The dock assembly of claim 21, wherein:

the first housing has an opening at one side of the first dock section; and the second housing has an opening at one side of the second dock section, such that the hinge assembly, when disconnected from the dock sections, can be removed from the housings via the openings in the housings.

25. The method of claim 17, wherein the hinge assembly comprises at least one layer of flexible belting material having a first end secured within the housing of the first dock section and a second end secured within the housing of the second dock section.

26. The method of claim 18, wherein the hinge assembly is removed from the housings laterally through side openings in the housings.

* * * * *